United States Patent [19]

Kirschke et al.

[11] Patent Number: 4,659,403

[45] Date of Patent: Apr. 21, 1987

[54] HYDRAZINE STABILIZERS FOR NC PROPELLANTS

[75] Inventors: Ernest J. Kirschke, Tallahassee, Fla.; Eugene F. Rothgery, North Branford, Conn.

[73] Assignee: Olin Corporation, Stamford, Conn.

[21] Appl. No.: 843,897

[22] Filed: Mar. 25, 1986

[51] Int. Cl.[4] ..... C06B 47/08

[52] U.S. Cl. ..... 149/36; 149/88; 149/94; 149/100; 149/108.8

[58] Field of Search ..... 149/36, 88, 94, 100, 149/108.8

[56] References Cited

U.S. PATENT DOCUMENTS 4,033,264 7/1977 Bolza et al. ..... 149/44

4,077,820 3/1978 Bolza et al. ..... 149/44

*Primary Examiner*—Stephen J. Lechert, Jr.

*Attorney, Agent, or Firm*—Bruce E. Burdick

[57] ABSTRACT

The invention relates to propellant powders and specifically to stabilizers for nitrocellulose-based propellant powders.

7 Claims, No Drawings

HYDRAZINE STABILIZERS FOR NC PROPELLANTS

BACKGROUND AND SUMMARY OF THE INVENTION

Nitric acid esters used in propellants undergo a steady decomposition due to incomplete purification of starting materials, temperature humidity. The rate of this decomposition is auto-catalyzed by the acid decomposition products and, in some cases, may result in a spontaneous ignition. In order to reduce the decomposition rate as much as possible, stabilizers are incorporated in the powder formulations. Products currently used for this purpose include diphenylamine, 2-nitrodiphenylamine and various substituted ureas such as Centralites. Several of these materials must be purchased from foreign sources.

It has been discovered that the addition of small amounts of various hydrazides to nitrocellulose-based powders causes a significant increase in their stability. The use of the hydrazides in combination with other stabilizers can lead to stabilities increased by several fold.

DETAILED DESCRIPTION OF THE INVENTION

The stabilizer compounds used in the present invention include the hydrazides and alkylhydrazides of various alkylcarboxylic acid, arylcarboxylic acids and substituted arylcarboxylic hydrazides. Also included in the invention are diacylhydrazide stabilizers. Table I below lists representative compounds of the various classes, but is not intended to portray all possible examples.

The hydrazides of carboxylic acids (1) are generally prepared by the reaction of hydrazine solutions with the appropriate acid (2), acid chloride (3), amide (4), or ester (5). The alkylhydrazides are best prepared by the reaction of an alkylhydrazine with the appropriate acid chloride or anhydride.

TABLE I

| COMPOUND NAME | CHEMICAL FORMULA |
|---|---|
| 1. ADIPIC DIHYDRAZIDE | $H_2NNHC(=O)(CH_2)_4C(=O)NHNH_2$ |
| 2. SEBACIC DIHYDRAZIDE | $H_2NNHC(=O)(CH_2)_8C(=O)NHNH_2$ |
| 3. STEARIC HYDRAZIDE | $C_{17}H_{35}C(=O)NHNH_2$ |
| 4. OXALIC DIHYDRAZIDE | $H_2NNHC(=O)C(=O)NHNH_2$ |
| 5. DIPROPIONIC HYDRAZIDE | $C_2H_5C(=O)NHNHC(=O)C_2H_5$ |
| 6. 3.5-DINITROBENZOIC HYDRAZIDE | 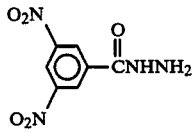 |

"A stabilizing amount" as used herein means an amount which is sufficient to stabilize nitrocellulose-base propellants such as WC872 at 120° C. for at least five hours when tested in accordance with method 404.1.2 below described. In the examples below, it was found that 50% hydrazide was sufficient to stabilize nitrocellulose and that 100% hydrazide was stable. This suggests that the "small amount" referenced above should be on the order of 10% of less, although the specific amount, which is the minimum to stabilize nitrocellulose powders, has not been determined. However, routine experimentation with decreasing amounts of hydrazide stabilizer would yield the precise amount which is "a stabilizing amount".

EXAMPLES

In order to evaluate the stability of the hydrazides and alkylhydrazides of various arylcarboxylic acids, diacylhydrazides and substituted arylcarboxylic hydrazides of the invention, military type reference powder SC872 with 100% WC872, 50% WC872/50% Hydrazide and 100% Hydrazide were tested according to MIL STD 286B, Method 404.1.2 which is as follows:

METHOD 404.1.2

HEAT TESTS (120° and 134.5° C.)

1. SCOPE 1.1 This method is used for estimating the stability of nitrocellulose as well as those propellants which react in a similar manner when subjected to a specified temperature, in the presence of indicator paper.

2. SPECIMEN 2.1 The specimen shall consist of approximately 2.5 gm of the propellant or the nitrocellulose.

Note: Tests are conducted simulaneously on five specimens at 120° C. However, when a 134.5° C. test is specified for nitrocellulose, only two specimens are tested.

3. APPARATUS 3.1 Constant temperature reflux bath, such as a solution of glycerin and water, the temperature of which is adjusted by varying its specific gravity. Alternatively, the apparatus may consist of a metal block, e.g., copper or aluminum. Either apparatus must be capable of maintaining the designed temperature ±0.5° C. The inner diameter of each thermowell in the apparatus shall be 19±0.5-mm.

Note: Check the temperature by inserting a thermometer (par. 3.5), or thermocouple tube (par. 3.2) in the apparatus, so that the bulb is about 12.5 mm above the bottom of the tube. For a temperature of 120°±0.5° C., the specific gravity of the reflux bath is approximately 1.21, for 134.5°±0.5° C., the specific gravity is 1.24.

3.2 Test tubes of pyrex or equivalent, approximately 15-mm id; 18-mm od; and 290-mm.

3.3 Standardized methyl voilet test paper, obtained from the Naval Propellants Plant and cut into pieces 20-mm by 70-mm.

3.4 Corks, containing breather holes 4-mm in diameter (or notches of equivalent area).

3.5 Thermometer, total immersion. Scale Divisions shall not be greater than 0.2° C.

4. PROCEDURE 4.1 Weight out each propellant specimen, using whole grains where possible. If it is necessary to cut any grains in preparing a specimen, cut them lengthwise. Transfer to test tubes.

4.2 Dry nitrocellulose specimens, weigh them, and press them into the bottom 2 inches of the test tube.

Note: Dry the nitrocellulose on paper trays for 2 hours at 38° to 42° C., or for one to 1½ hours at 48° to 52° C. If preferred, dry it overnight to room temperature, with further drying for 30 minutes at 38° to 42° C.

4.3 Into each tube place a piece of the test paper (par 3.3) vertically so that the lower end of the paper is 25-mm from the specimen.

4.4 Place a cork (par 3.4) in each tube, and set the tubes in the beth at the specified temperature.

Note: No more than 6 to 7 mm of the tubes should project above the bath.

4.5 Test specimens as follows:

(a) Ascertain the minimum time requirement for the heat test from the detail specification.

(b) When 5 minutes less than the specified time has elapsed, examine the test papers in the tubes to see if they have changed completely to salmon pink. This is done by lifting the tube half way out of the bath, and quickly replacing it. When the test paper in any tube has changed color completely, the test is considered complete.

(c) If none of the papers have changed completely, continue the heating, and recheck the tubes at 5-minute intervals. Record the time to completion of the test. With some propellants, a small band of green or brown may appear on the paper. In general, these extraneous colors may be ignored.

(d) Heating of the tubes may be continued to determine whether a specimen will explode in less than 5 hours.

4.6 Test nitrocellulose specimens by examining the test paper after the first 20 minutes in the bath, and thereafter at 5-minute intervals until the completion of the test. Examine the papers as described in paragraph 4.5; discontinue the test when the salmon pink end point is attained in any of the papers. Record the test time.

The results of the test, run according to the above method, on the compound indicated below are summarized in Table II.

TABLE II

| Compound | 120° C. (Salmon Pink) Minutes | 120° C. (Explosion) Minutes |
|---|---|---|
| WC 872 | 80 | 300+ |
| Adipic Dihydrazide: | | |
| % 50/50 | 300+ | 300+ |
| % 100 | 300+ | 300+ |
| Sebacic Dihydrazide: | | |
| % 50/50 | 300+ | 300+ |
| % 100 | 300+ | 300+ |
| Stearic Hydrazide: | | |
| % 50/50 | 300+ | 300+ |
| % 100 | 300+ | 300+ |
| Oxalic Dihydrazide: | | |
| % 50/50 | 300+ | 300+ |
| % 100 | 300+ | 300+ |
| Dipropionic Hydrazide: | | |
| % 50/50 | 240+ | 300+ |
| % 100 | 300+ | 300+ |
| 3,5-Dinitrobenzoic Hydrazide: | | |
| % 50/50 | 180+ | 300+ |
| % 100 | 300+ | 300+ |

In view of the above results, it can be recognized that in propellants having at least 50% by weight stabilizer the stabilizers listed do indeed satisfactorily stabilize nitrocellulose-base propellants such as WC 872 even at 120° C. for at least 5 hours, which is considered successful stabilization.

What is claimed is:

1. A nitrocellulose based propellant powder stabilized by the addition of a stabilizing amount of a hydrazide compound to the propellant.

2. The propellant of claim 1 wherein the hydrazide compound is adipic dihydrazide.

3. The propellant of claim 1 wherein the hydrazide compound is sebacic dihydrazide.

4. The propellant of claim 1 wherein the hydrazide compound is stearic hydrazide.

5. The propellant of claim 1 wherein the hydrazide compound is exalic dihydrazide.

6. The propellant of claim 1 wherein the hydrazide compound is dipropionic hydrazide.

7. The propellant of claim 1 wherein the hydrazide compound is 3,5-dinitrobenzoic hydrazide.

* * * * *